US007325684B1

(12) United States Patent
Ramos

(10) Patent No.: US 7,325,684 B1
(45) Date of Patent: Feb. 5, 2008

(54) ORGANIZER PLUS

(76) Inventor: Margarita Ramos, 2956 N. Sierra Way, San Bernardino, CA (US) 92405

( * ) Notice: Subject to any disclaimer, the term of this patent is extended or adjusted under 35 U.S.C. 154(b) by 497 days.

(21) Appl. No.: 10/966,735

(22) Filed: Oct. 14, 2004

Related U.S. Application Data

(60) Provisional application No. 60/511,972, filed on Oct. 15, 2003.

(51) Int. Cl.
*B65D 85/00* (2006.01)

(52) U.S. Cl. ..... 206/425; 206/449

(58) Field of Classification Search ..... 206/214, 206/371, 425, 449; 229/67.1, 67.3
See application file for complete search history.

(56) References Cited

U.S. PATENT DOCUMENTS

| | | | | |
|---|---|---|---|---|
| 4,274,567 | A | 6/1981 | Sawyer | |
| 4,450,994 | A | 5/1984 | Holland | |
| 4,463,848 | A | 8/1984 | Parker | |
| 4,958,728 | A * | 9/1990 | Effendi | 206/425 |
| 4,966,318 | A | 10/1990 | Dutka | |
| 5,002,215 | A * | 3/1991 | Gregoire | 224/277 |
| 5,494,161 | A * | 2/1996 | Herbst | 206/425 |
| 5,630,509 | A * | 5/1997 | Su | 206/425 |
| 6,558,063 | B2 * | 5/2003 | Ho | 402/73 |
| 6,945,399 | B1 * | 9/2005 | Ong | 206/425 |
| 7,156,232 | B1 * | 1/2007 | Holson | 206/425 |
| 2003/0183679 | A1 * | 10/2003 | Ong | 229/67.3 |
| 2004/0035736 | A1 * | 2/2004 | Peleman | 206/425 |

* cited by examiner

*Primary Examiner*—David T. Fidei

(57) ABSTRACT

An organizer for household use. The organizer is designed to have a plurality of coupon sleeves placed in an outer box frame that has a pivotally attached top lid. The coupon sleeves are fixedly attached within the outer box frame and can be organized by different categories to sort coupons, recipes, bills, or other common household items.

4 Claims, 4 Drawing Sheets

ORGANIZER PLUS

I. CROSS-REFERENCE TO RELATED APPLICATIONS

This application claims the benefit of U.S. Provisional Application No. 60/511,972, filed Oct. 15, 2003.

II. BACKGROUND OF THE INVENTION

The present invention concerns that of a new and improved organizer for household use.

III. DESCRIPTION OF THE PRIOR ART

U.S. Pat. No. 4,966,318, issued to Dutka, discloses a shopping cart organizing device comprised of an accordion type receptacle suited to be held in the seat portion.

U.S. Pat. No. 4,463,848, issued to Parker, discloses a coupon organizer file that can be stored in the seat of a grocery cart.

U.S. Pat. No. 4,450,994, issued to Holland, discloses a box that is supported in the basket of a shopping cart, allowing a shopper to organize coupons.

U.S. Pat. No. 4,274,567, issued to Sawyer, discloses an expandable file device for placement on the seat of a shopping cart to hold coupons in an orderly manor.

IV. SUMMARY OF THE INVENTION

The present invention concerns that of a new and improved organizer for household use. The organizer is designed to have a plurality of coupon sleeves placed in an outer box frame that has a pivotally attached top lid. The coupon sleeves are fixedly attached within the outer box frame and can be organized by different categories to sort coupons, recipes, bills, or other common household items.

There has thus been outlined, rather broadly, the more important features of a household organizer that the detailed description thereof that follows may be better understood and in order that the present contribution to the art may be better appreciated. There are, of course, additional features of the household organizer that will be described hereinafter and which will form the subject matter of the claims appended hereto.

In this respect, before explaining at least one embodiment of the household organizer in detail, it is to be understood that the household organizer is not limited in its application to the details of construction and to the arrangements of the components set forth in the following description or illustrated in the drawings. The household organizer is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present household organizer. It is important, therefore, that the claims be regarded as including such equivalent constructions insofar as they do not depart from the spirit and scope of the present invention.

It is therefore an object of the present invention to provide a household organizer which has all of the advantages of the prior art and none of the disadvantages.

It is another object of the present invention to provide a household organizer which may be easily and efficiently manufactured and marketed.

It is another object of the present invention to provide a household organizer which is of durable and reliable construction.

It is yet another object of the present invention to provide a household organizer which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
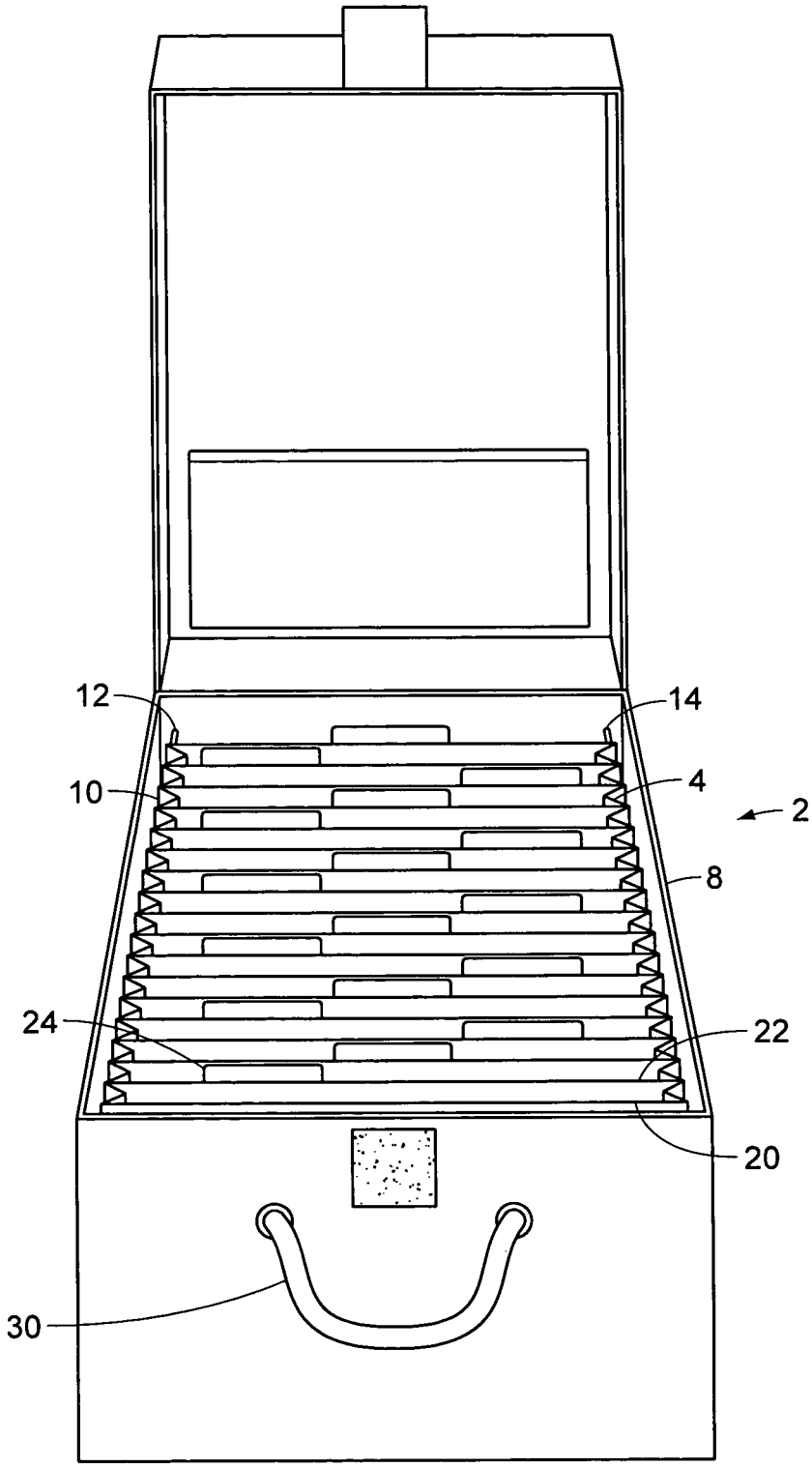
FIG. 1 shows a frontal top view of the organizer with included sleeves before the tabs are attached to the sleeves.
Figure 2:
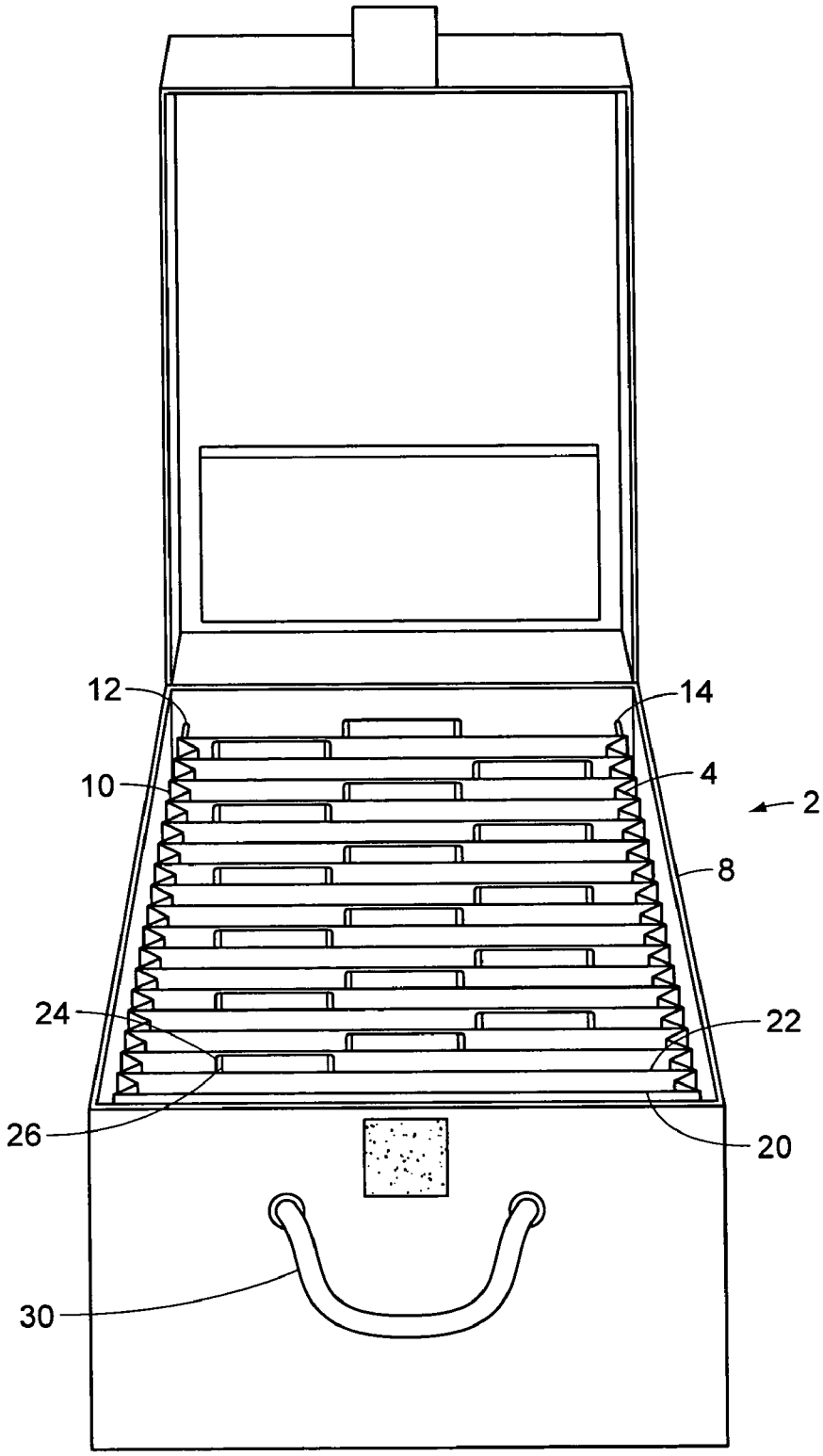
FIG. 2 shows a frontal top view of the organizer with included sleeves after the tabs are attached to the sleeves.

FIG. 1 shows a frontal top view of the organizer 2 with included sleeves 4 before the tabs 26 are attached to the sleeves, while FIG. 2 shows a frontal top view of the organizer 2 with included sleeves 4 after the tabs 26 are attached to the sleeves. Organizer 2 itself has an outer box frame 8 which has two ends, a front end and a rear end, two sides, a left side and a right side, and a bottom side. Box frame 8 also has a top, with the top being further illustrated in FIGS. 3 and 4.

Sleeves 4 are part of an accordion file 10 which is permanently affixed within outer box frame 8. Two support poles 12 and 14 run from the front end to the rear end of the outer box frame 8 within the outer box frame 8, with the accordion file 10 being mounted on the support poles 12 and 14. The support pole 12 is located near the left side of the outer box frame 8, while the support pole 14 is located near the right side of the outer box frame 8.

In FIGS. 1 and 2, support poles are shown to be inserted through the upper corners of each of the sleeves 4 of the accordion file, which provides the best mounting capability for the accordion file 10. However, poles 12 and 14 could be placed lower than what they are shown in FIGS. 1 and 2, as long as they are located on the sides of the sleeves 4 (so they don't interfere with the storage capacity of the sleeves 4).

There are a plurality if sleeves 4 within the accordion file 10, with the plurality preferably equaling seventeen (17). However, a lesser or greater number of sleeves 4 could be used in lieu of seventeen.

Each sleeve 4 has two inner surfaces, a front surface 20 and a rear surface 22, with each surface having two ends, a top end and a bottom end. The rear surface 22 of each sleeve faces forward and has a plurality of slots 24 for insertion of one or more tabs 26, as seen in FIG. 2. Each of the tabs 26 are open-sided and allow insertion of labels 28 within each tab 26. The slots are located near the top end of each sleeve 4. There is at least one tab 26 in each sleeve 4, with a single label 28 being placed into each tab 26.

Each sleeve 4 preferably has a height of four inches and a length of six and three-fourths inches. Each tab 26 preferably has a height of one-half inch and a length of one and one-half inches. Outer box frame 8 preferably has a height of three and one-half inches, a width of seven and one-half inches, and a length of seven inches. The length dimension is measured from the front end to the rear end of the outer box frame 8.

Outer box frame 8 has a handle 30 attached to the outer surface of the front end of outer box frame 8. Handle 30 is preferably either a plastic rope or canvas handle.

Figure 3:
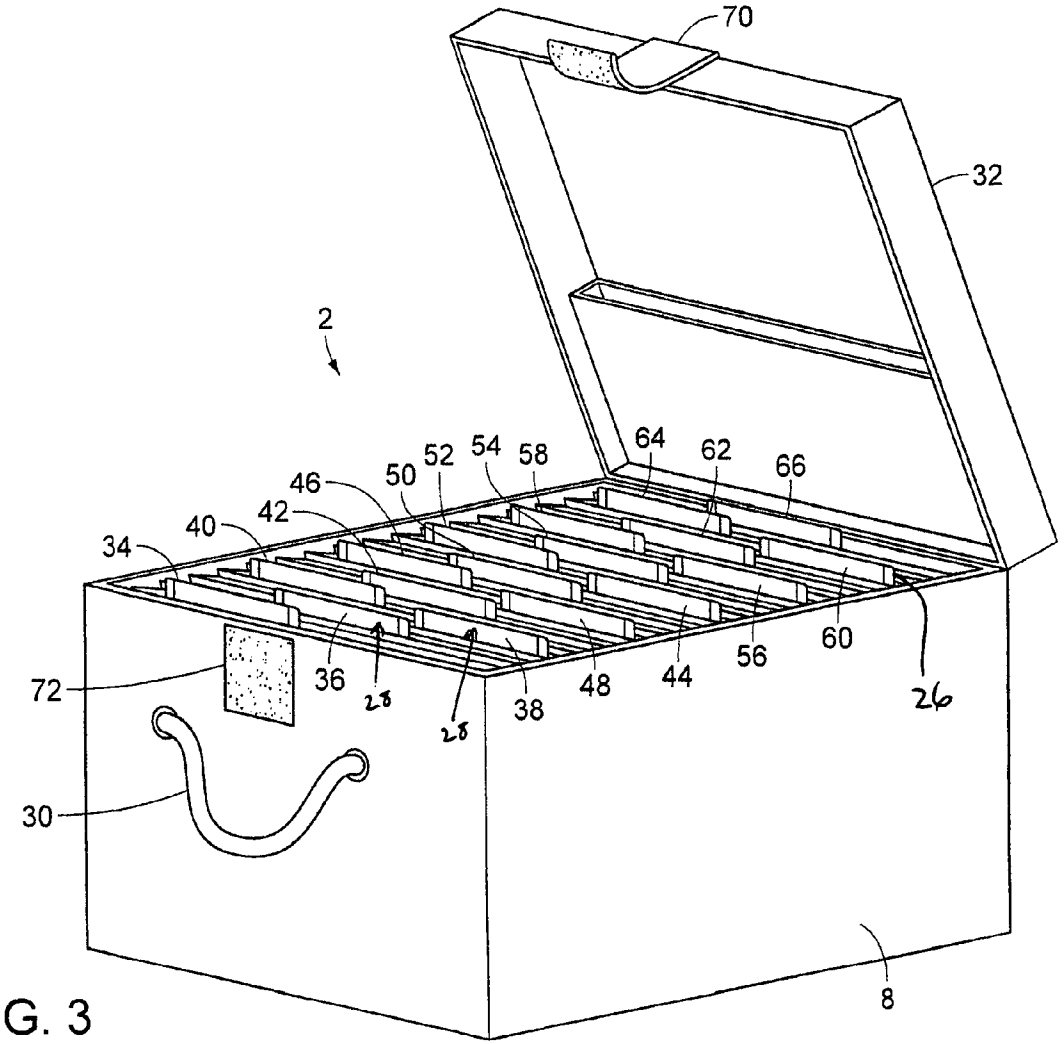
FIG. 3 shows a perspective view of the organizer with included sleeves after the tabs are attached to the sleeves and the top section of the organizer is opened.

FIG. 3 shows a perspective view of the organizer 2 with included sleeves 4 after the tabs 26 are attached to the sleeves 2 and the top section 32 of the organizer is opened. Top section 32 is pivotally attached to the top of the rear end of the outer box frame 8. As can be seen in FIG. 3, there are seventeen preferred categories to be placed on the labels 28 within the tabs 26. The categories are listed as follows:

1. Breakfast, drinks (shown as label 34).
2. Baking goods, nuts, candy (shown as label 36).
3. pudding, applesauce, jello, fruit cups (shown as label 38).
4. Ketchup, mayo, bbq sauce, pickles (shown as label 40).
5. Mex, foods, salsas (shown as label 42).
6. Breads, spices, oil (shown as label 44).
7. Butter, dairy products (shown as label 46).
8. Cookies, chips, crackers (shown as label 48).
9. Can foods, salad dressings (shown as label 50).
10. Pastas, rice, beans (shown as label 52).
11. Frozen foods, ice cream (shown as label 54).
12. Baby items, jam, peanut butter (shown as label 56).
13. Shampoo, soap, toothpaste, health aids (shown as label 58).
14. Paper items, foil, baggies (shown as label 60).
15. Cleaning supplies, laundry items (shown as label 62).
16. Dog food, restaurant coupons (shown as label 64).
17. Medications (shown as label 66).

Figure 4:
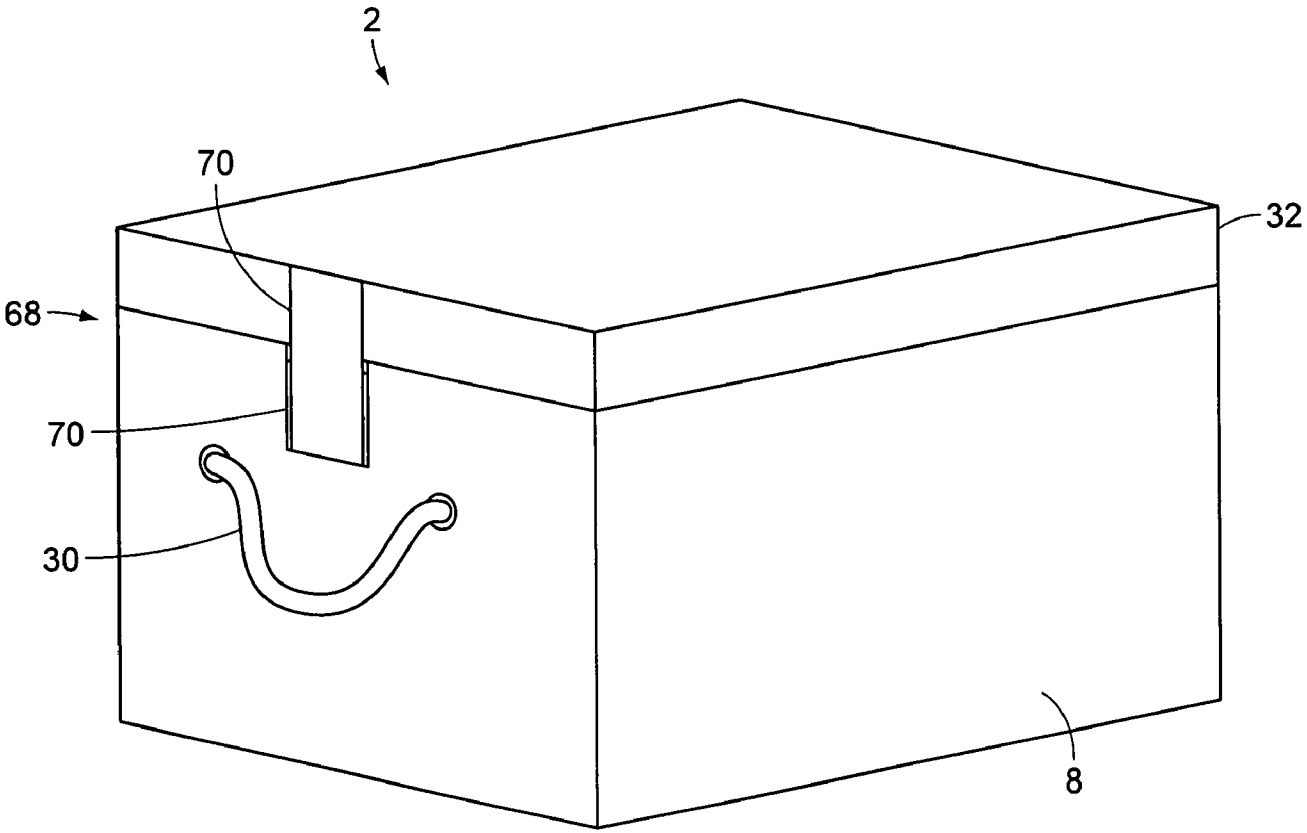
FIG. 4 shows a perspective view of the organizer with included sleeves after the top section of the organizer has been closed.

FIG. 4 shows a perspective view of the organizer 2 after the top section 32 of the organizer 2 has been closed. The front end of top section 32 can be removably attached to the front surface of front end of the outer box frame 8 by attachment means 68. Attachment means 68 is preferably a pair of patches 70 and 72, with patch 70 attached to top section 32 and patch 72 attached to the front end of the outer box frame 8. Patch 70 and 72 are complementary hook and loop attachment system, with one of the patches having a plurality of individual hooks and the other patch having a plurality of individual loops.

I claim:

1. An organizer comprising:

an outer box frame that has a front end, a rear end, a left side, a right side, and a bottom side, a top section pivotally attached to the top of the rear end of the outer box frame, an accordion file located within the outer box frame, a plurality of sleeves located within the accordion file, each sleeve having a front surface, a rear surface, a top end, and a bottom end, a plurality of tabs located within the accordion file, at least one tab located on each sleeve, means for providing structural support for the accordion files comprising a first pole running from the front end to the rear end of the outer box frame within the outer box frame, the first pole being located near the left side of the outer box frame, a second pole running from the front end to the rear end of the outer box frame within the outer box frame, the second pole being located near the right side of the outer box frame, wherein the accordion file is mounted on the first pole and the second pole, a handle attached to the front end of the outer box frame, and a plurality of labels placed within the tabs, wherein one label is placed within each tab.

2. An organizer according to claim 1 wherein the plurality of sleeves preferably numbers seventeen (17) sleeves.

3. An organizer according to claim 1 wherein the handle is fabricated from plastic rope.

4. An organizer according to claim 1 wherein the handle is fabricated from canvas.

* * * * *